299-13 SR
8/29/78 XR 4,109,964

United States Patent [19] [11] 4,109,964
Ridley [45] Aug. 29, 1978

[54] METHOD FOR PRECONDITIONING OIL SHALE PRELIMINARY TO EXPLOSIVE EXPANSION AND IN SITU RETORTING THEREOF

[75] Inventor: Richard D. Ridley, Grand Junction, Colo.

[73] Assignee: Occidental Oil Shale, Inc., Grand Junction, Colo.

[21] Appl. No.: 756,112

[22] Filed: Jan. 3, 1977

Related U.S. Application Data

[63] Continuation-in-part of Ser. No. 651,288, Jan. 22, 1976, abandoned, which is a continuation of Ser. No. 447,240, Mar. 1, 1974, abandoned.

[51] Int. Cl.[2] ..... E21B 43/26
[52] U.S. Cl. ..... 299/2; 166/259; 299/13
[58] Field of Search ..... 102/22, 23; 299/2-5, 299/14, 13, 21; 166/259

[56] References Cited

U.S. PATENT DOCUMENTS

| | | | |
|---|---|---|---|
| 3,233,668 | 2/1966 | Hamilton et al. | 166/259 |
| 3,464,490 | 9/1969 | Silverman | 166/245 |
| 3,586,377 | 6/1971 | Ellington | 299/4 |
| 3,593,788 | 7/1971 | Parker | 166/247 |
| 3,677,342 | 7/1972 | Silverman | 166/247 |

*Primary Examiner*—Ernest R. Purser
*Assistant Examiner*—William F. Pate, III
*Attorney, Agent, or Firm*—Christie, Parker & Hale

[57] ABSTRACT

A technique is provided for forming, in a subterranean deposit containing oil shale, an in situ oil shale retort having boundaries of unfragmented deposit containing a fragmented permeable mass of particles containing oil shale. The technique is particularly useful where at least a portion of the deposition layers of the oil shale deposit within the boundaries of the retort being formed are bonded together as a competent or relatively strong bed resistant to fragmenting. A portion of the deposit within the boundaries of the retort being formed is excavated to form a void with a free face within the boundaries. A second portion of the deposit within the boundaries extending away from the free face includes at least one competent bed. At least one competent bed within the boundaries is fractured substantially parallel to the deposition layers for reducing the effective thickness of the competent bed. The portion of the deposit within the boundaries of the retort being formed is then explosively expanded toward the void with a single round of explosives for fragmenting this portion of the deposit and forming a fragmented permeable mass of particles in an in situ oil shale retort. The fragmented mass is retorted to produce liquid and gaseous products including shale oil.

24 Claims, 8 Drawing Figures

Fig. 1
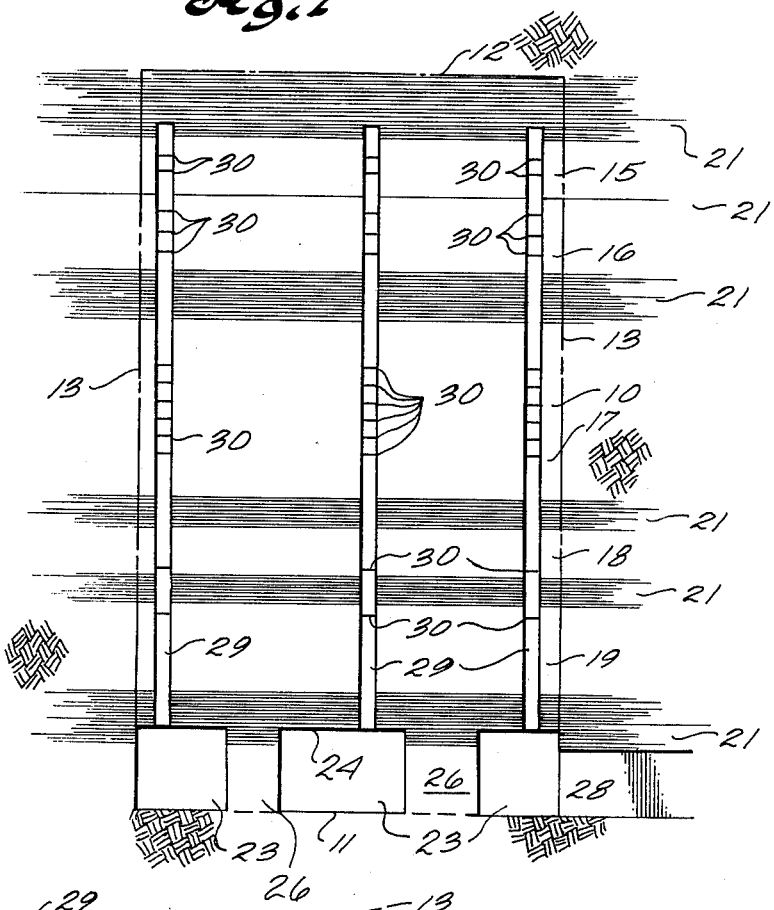
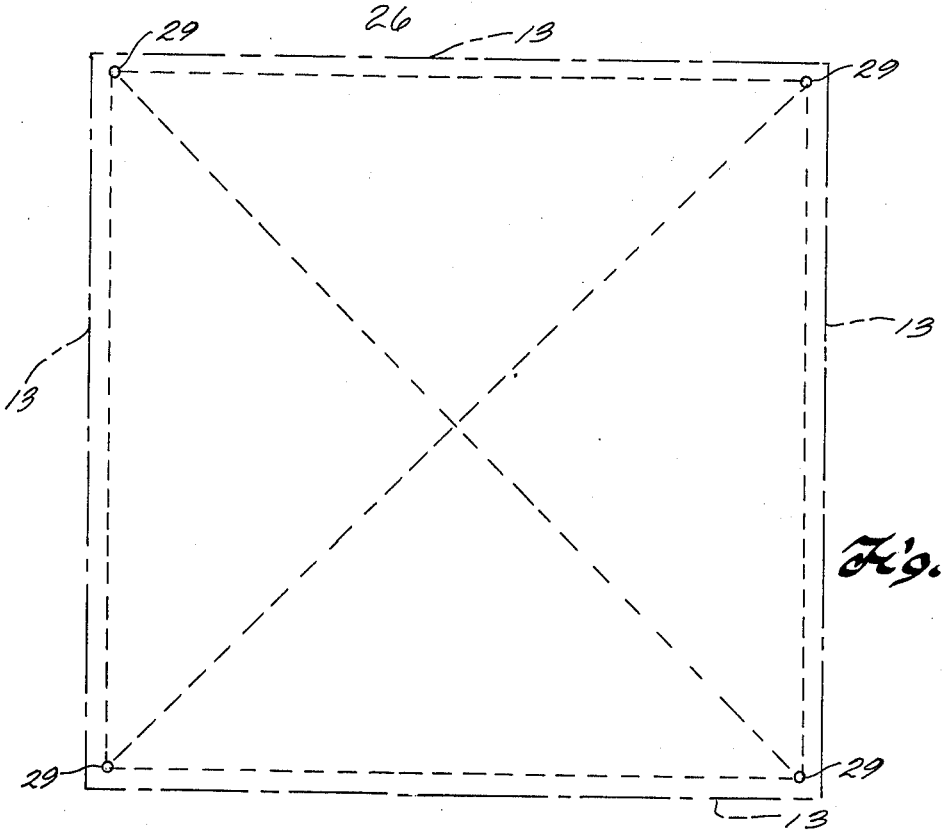
Fig. 2

METHOD FOR PRECONDITIONING OIL SHALE PRELIMINARY TO EXPLOSIVE EXPANSION AND IN SITU RETORTING THEREOF

BACKGROUND

This is a continuation-in-part of my co-pending patent application, Ser. No. 651,288 filed Jan. 22, 1976, which is a continuation of my patent application Ser. No. 447,240 filed Mar. 1, 1974, both of which are now abandoned.

The present application relates in general to oil shale retorting and to an improved technique for forming an in situ oil shale retort.

There exists in this country, as well as in other locations in the world, vast untapped reserves of oil shale. The term "oil shale" as used in the industry is, in fact, a misnomer. It is neither shale nor does it contain oil. It is a formation or deposit generally comprising marlstone containing an organic composition called "kerogen" which upo heating decomposes to produce liquid and gaseous products. Deposits containing kerogen are called "oil shale" herein and the carbonaceous liquid product recovered by heating or retorting oil shale is referred to as "shale oil".

Increased attention is being devoted to in situ exploitation of oil shale. In situ retorting of oil shale offers economical exploitation because, among other things, the oil shale need not be mined for retorting in surface retorts. As a consequence, site preparation is not as extensive and the appearance of the site after product removal need not be greatly altered. It is therefore desirable to form an in situ oil shale retort in a subterranean oil shale deposit.

In one retorting process shale within the boundaries of the in situ oil shale rotort being formed is fragmented to form a fragmented permeable mass containing oil shale particles. Carbonaceous material in the fragmented mass at the top of the retort is ignited to establish a combustion zone. An oxygen supplying gas, such as air or air diluted with recycled off gas from an in situ oil shale retort, is introduced into the combustion zone to sustain the combustion zone. Flow of gas downwardly through the fragmented mass in the in situ oil shale retort causes the combustion zone to advance downwardly through the fragmented mass. As burning of carbonaceous material proceeds the heat of combustion is transferred to shale below the combustion zone by flowing gas to produce liquid and gaseous products including shale oil from oil shale in a retorting zone. Thus, a retorting zone advances from top to bottom of the retort in advance of the combustion zone and the resulting shale oil and gaseous products pass to the bottom of the retort for collection and recovery. Other techniques for advancing a retorting zone through a fragmented mass of particles in an in situ oil shale retort have also been described.

In preparation for the described retorting process, it is important that deposit within the boundaries of the retort being formed by fragmented and expanded, rather than simply fractured, to create high permeability; otherwise too much pressure is required to pass processing gas through the in situ oil shale retort.

As used herein the terms "fracturing" and "fragmenting" are essentially mutually exclusive. Fracturing means producing breaks in the continuity of a body of rock not attended by appreciable movement on one side or the other of the break. It is a general term for producing discontinuities, cracks or fissures in the body of rock by mechanical failure, whether by shear stress, tensile stress or other means. Fragmenting refers to the breaking of a body of rock into a multiplicity of separate pieces attended by substantial expansion of the total volume occupied by the rock. When rock expands, separate pieces or particles are broken off or detached from each other and portions of the particles are displaced by translation and/or rotation to leave irregular spaces between the pieces. Expansion is toward a preexisting void and the void volume is redistributed into the spaces between particles. The average void fraction of the expanded or fragmented rock corresponds to the proportion of the volume of the void relative to the total volume of the void plus the rock expanded toward the void.

Fracturing develops cracks or fissures which may be completely closed with the rock on opposite sides of the crack being in close contact, or which may be opened slightly so that a narrow space exists between the opposite sides of the crack. Artificial means are sometimes employed to keep a crack produced by artificial fracturing propped open. Expansion of the volume occupied by the body of rock is negligible when it is fractured. In some fracturing processes, such as blasting, minor fragmenting can occur. For example, pulverized rock next to a blasting hole can be fragmented and expand into the volume of the hole. The main body of the rock can be cracked or fractured without noticeable expansion. As another example, a crack through a body of rock may split and rejoin to detach a fragment from the opposite sides of the crack. The body of rock through which fractures are formed remains essentially intact after fracturing even though it contains internal cracks and discontinuities. Its shape is essentially unchanged by fracturing.

In forming a fragmented permeable mass or rubble pile of deposit particles, fragmenting moves the rock particles and expands the total volume occupied by the rock. If there is unlimited room for expansion the spaces between rock particles can be from about 30 to 50 percent of the total volume of the rubble pile of rock particles. That is, the void fraction can be from about 30 to 50 percent. If the fragmented rock expands towards a void of limited volume, so that the void is filled by the rubble pile of rock particles, the space in the void becomes distributed through the rubble pile in the form of irregular spaces between particles. This void space distributed through the rubble pile is referred to as the void fraction or void volume. If the average void fraction is 15%, for example, the volume of the rubble pile occupied by the rock particles is 85% of the total and the aggregate volume of the spaces between particles is 15% of the total. Upon fragmenting the rock loses its original form and the resulting rubble pile assumes a shape defined by confining boundaries and gravity.

Fractures are a part of fragmenting to the extent that it is necessary to form cracks or discontinuities in the rock before the particles can be detached and moved. For example, during fragmenting by blasting, a portion of the energy expended is for "fracture energy" in disrupting the bonds holding the rock together; that is, creating new surface area. Other energy is for the work of moving the rock. Some energy is dissipated as sonic, seismic and thermal losses. Although "fragmenting" includes "fracturing" in a theoretical sense, it is a distinct process involving more than just the formation of cracks. "Fragmenting" as used herein and in practical application is different from "fracturing".

One technique for forming an in situ retort involves removal by undercutting of material underneath the portion of the oil shale deposit to be retorted to create a void with a ceiling forming a horizontal free face. The overlying deposit containing oil shale is then expanded toward the void. Expansion is accomplished by allowing the ceiling above the void to collapse of its own accord or by explosive charges in the ceiling, or a combination of these techniques. An undercutting technique used to fragment an oil shale deposit is attractive in many deposits. It can be made more attractive in some deposits by using a prefracturing technique to enhance fragmenting as provided in practice of this invention.

Another technique for forming an in situ oil shale retort involves excavation of a generally vertically extending void within the boundaries of the oil shale retort being formed. The free face of the oil shale deposit remaining within the retort boundaries, that is, the interface between the void and the unfragmented shale extends vertically through the deposit as contrasted with the free face of the undercut which extends horizontally through the deposit. Prefracturing of a portion of the deposit as a part of this technique for forming a retort can assist in fragmenting.

Oil shale deposits occur in generally horizontal formations in the Western United States. Within a given formation there are an extremely large number of very thin generally horizontal deposition layers known as varves. In some instances the varves are tightly bonded together into thick compact competent or relatively strong beds which can be likened to thick structural beams. These competent beds are often associated with the higher grade oil shale, that is, the shale having a higher kerogen content. A competent bed can be considered to be a rock formation which, because of its massiveness, or inherent strength, is able to support not only its own weight but also that of overlying rock.

Within the same deposit, however, there may be much thinner layers of varves which are also bonded together like a much thinner structural beam. The mechanical properties of the thinner composite layer may be similar to those of the thicker competent bed but because of the lesser thickness of the layer it is not as effective as a structural beam in carrying weight. In the deposit small beds or layers of other minerals are sometimes found interspersed between thick or thin layers of oil shale. Examples of such other minerals are dolomite, mudstone, sandstone, tuff, analcite, and bentonite. The interfaces between layers, whether between layers of oil shale or other minerals, can be relatively weak and fracture easily.

As previously mentioned, in the undercutting technique a ceiling is left above the excavated void. The strength of the ceiling depends on the length of the ceiling that is unsupported, the thickness of the beam-like competent bed in the ceiling, the pressure of the overlying formation, and the mechanical properties of the deposit. For purposes of analysis, the deposit above the void can be considered as layers of individually loaded beams. When vertical blasting holes for explosive are drilld through a series of these ceiling beams, loaded with explosive and detonated, the tendency is to fracture the beams only to the point where they drop as a horizontal unit. While some fracturing occurs in a zone radiating from each explosive detonation point, thick beams may tend to drop as a unit without splitting horizontally along planes between the varves constituting the thick structural beams. While the tendency of thick beams to drop as a unit without fragmenting can be compensated to some extent by overloading with explosives, the results can be disappointing.

Similarly in the technique for expanding towards a generally vertically extending void, breaking is most likely to occur along planes of inherent weakness. Competent beds can yield large size particles of oil shale which may not retort rapidly or thoroughly.

The explosive energy required to adequately fragment an oil shale deposit is determined by, among other things, the thickness of the thickest or strongest competent bed to be broken, as well as the total tonnage of shale to be expanded. Because of the effect of the thickest beam in the deposit to be expanded, the charge density is a function of the thickest individual competent bed. Consequently, when columnar charges of explosive normal to bedding planes are used, there can be an excess amount of explosive where the beds of the deposit to be expanded are thinnest. In other words, the thin layers tend to fragment without a large amount of explosive and to that extent there is a waste of explosive. When columnar charges are not used, and explosive is selectively distributed in the shale to be expanded, there can be an excessive amount of drilling required since the total length of the drilled holes may not be utilized.

In sum, the presence of relatively thick sections of shale acting as competent beds within the deposit to be expanded for in situ oil shale retorting leads to potential problems in arriving at proper oil shale piece size, effective utilization of explosive and effective utilization of drill holes required to expand the deposit.

BRIEF SUMMARY OF THE INVENTION

There is, therefore, provided in practice of this invention a technique for forming an in situ oil shale retort in a subterranean oil shale deposit wherein at least a portion of the deposition layers are bonded together as a competent bed. The retort has boundaries of the deposit and contains a fragmented permeable mass of particles containing oil shale. A first portion of the deposit within the boundaries of the retort being formed is excavated to form a void having at least one free face extending through the deposit within the boundaries. A second portion of the deposit within boundaries, including at least one competent bed, is left in place extending away from such a free face. At least one competent bed within the bounaries of the retort being formed is fractured parallel to the deposition layers for reducing the effective thickness of the competent bed. Thereafter, the second portion of the deposit is explosively expanded toward such a free face for forming a fragmented permeable mass of particles in the in situ oil shale retort.

DRAWINGS

These and other features and advantages of the present invention will be better appreciated from the following detailed description when considered in connection with the accompanying drawings wherein:

FIG. 1 is a semi-schematic elevational cross section of an in situ oil shale retort being formed;

FIG. 2 is a semi-schematic plan view of the volume of oil shale to be expanded for forming an in situ oil shale retort;

DESCRIPTION

Figure 3:
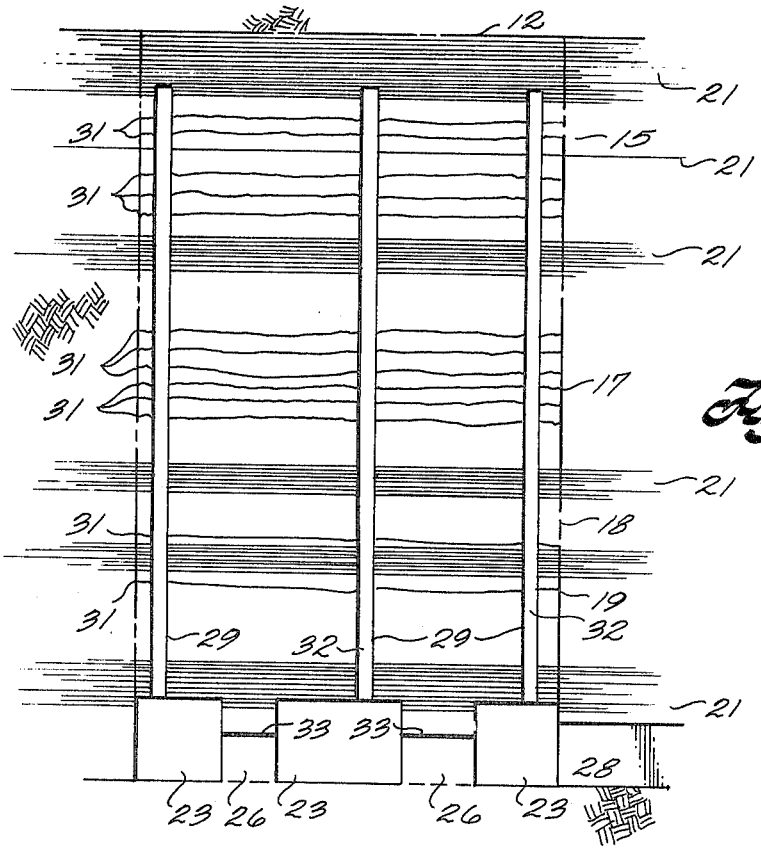
FIG. 3 is a view similar to FIG. 1 after fracturing portions of the oil shale deposit.

Practice of this invention according to presently preferred embodiments relates to in situ retorting of a portion of an oil shale deposit or seam expanded into a volume larger than that which it occupied prior to expansion. This increase in volume is effected by excavating a portion of the deposit to develop a void into which a portion of the deposit containing oil shale is expanded, preferably by explosives. Efficient in situ oil shale retorting involves good circulation of processing or retorting gases through the retort. Oil shale within boundaries of the in situ retort being formed is explosively fragmented and expanded to produce a fragmented permeable mass of particles having good bulk permeability or a relatively high void fraction. In an exemplary retorting process about 5000 to 15,000 standard cubic feet of air or other processing gas is used per ton of shale retorted. The gases should be passed through the fragmented mass of particles containing oil shale with a minimum pressure drop to conserve pumping energy. the bulk permeability of the fragmented mass should be distributed throughout the retort in such a manner that all of the oil shale within the retort is contacted by or in close proximity to the retorting gas. To this end the oil shale deposit is broken into pieces so that there are spaces between the particles through which gas can flow. The U.S. Bureau of Mines has shown that individual piece sizes as large as 2 cubic yards can be retorted.

In one embodiment of the present invention a portion of the oil shale deposit to be retorted is undercut to form a void beneath oil shale to be expanded. Thus, a first portion of the deposit within the boundaries of the retort to be formed is excavated and a second portion within those boundaries is subsequently expanded. The ceiling of the void forms a horizontal free face towards which oil shale is free to move under the force of explosive upon expansion towards the void. The undercut void leaves broad expanses of ceiling between supporting pillars. Drill holes from the undercut void are extended vertically through the ceiling to about the top of the portion of the deposit to be expanded. These drill holes extend at least to the competent beds to be fractured in practice of this invention.

Means for fracturing the competent beds (such as electrodes and/or hydraulic packers) are installed in the drill holes in a pattern determined by the location of the thicker competent beds in the deposit and the thickness of these competent beds. The thicker competent beds are fractured to develop horizontal fractures which subsequently reduce the strength of the competent beds as compared with the strength that they had before fracturing.

The competent beds are fractured by any of a number of known fracturing techniques. Electrical fracturing, sometimes known as electro-linking, can be used for creating a fracture between electrodes in spaced apart drill holes. The technique for inducing fracturing can involve application of hydraulic pressures. In such a technique conventional oil well packers are installed in a drill hole to isolate the region to be fractured. Hydraulic pressure is applied between the packers for creating and enlarging fractures around the drill hole. Hydraulic fracturing can be used to enlarge fractures initiated by electrical fracturing. Explosives, including liquid explosives injected under pressure, can be used for initiating and enlarging fractures. Explosive techniques can be used for enlarging fractures initiated by electrical and/or hydraulic fracturing.

For a description of the type of fracturing techniques which can be employed in the present invention one can consult "Evaluation of Oil Shale Fracturing Tests Near Rock Springs, Wyoming" by G. G. Campbell, W. G. Scott and J. S. Miller, (Report of Investigations 7397, U.S. Department of the Interior, Bureau of Mines); "Explosives Research to Improve Flow Through Low-Permeability Rock", J. L. Eakin and J. S. Miller (Journal of Petroleum Technology, November 1967); and "Fracturing Oil Shale with Electricity", Noel M. Melton and Theodore S. Cross (Quarterly of the Colorado School of Mines).

Formation of horizontal fractures in a competent bed essentially divides the thick structural beam into a plurality of thin beams separated by the fractures. The fracturing of a thick beam-like competent bed into several smaller beam-like layers results in a significant weakening of the deposit to be expanded and retorted.

An example of the efficacy of the fracturing process of the present invention is in the fracturing of a relatively thick beam-like competent bed into four smaller beams. Assuming that along fracture planes there is complete separation and there is no friction tending to hold the fractured layers together, the resultant four smaller beams have only one-quarter the strength of the original unfractured beam. In addition these planes of fracture increase beam deflection by a factor of 16. Thus fracturing reduces the effective thickness of a competent bed and makes it behave more like a number of layers of smaller thickness. It should be noted that the fracturing technique is an opposite of roof bolting of multiple lamina mine roofs where the object is to improve the strength of the roof by having the roof approach the strength of a single beam. In actual practice, of course, there are frictional effects acting between the layers on opposite sides of the fracture. These frictional effects tend to strengthen the resultant fractured formation and as a consequence the effective thickness or strength reduction is not as much as would be the case were complete separation of layers along fractures to occur.

With the fracturing process of the present invention the size of the larger oil shale particles after expansion is a function of the vertical distance betwen horizontal fractures. The amount of explosive energy required to fragment and expand the deposit prior to retorting is an inverse function of the amount of weakening produced by fractures. The number of drill holes required for explosives can also be reduced as a function of the amount of deposit weakening due to preconditioning fracturing.

Referring now to FIGS. 1 and 2, there is illustrated semi-schematically a site for in situ retorting of oil shale. The portion of the oil shale deposit to be expanded is bounded by phantom lines in the figures. Thus, the volume of the oil shale deposit to be expanded to form the in situ oil shale retort has a top boundary 11, bottom boundary 12, and side boundaries 13. The volume within these boundaries is entirely below the ground surface.

The deposit of oil shale consists of an extremely large number of relatively thin deposition layers called varves. Some of these deposition layers are tightly bonded together to form individual relatively thick layers, each of which acts as a compact, competent bed. In FIG. 1, several of these thick competent beds are indicated by reference numerals 15, 16, 17, 18 and 19. Thinner, tightly bound layers of varves are also present in the deposit and are indicated by reference numerals 21. Within the deposit there are also other minerals in layers such as dolomite, mudstone, sandstone, tuff, analcite, and bentonite. The interfaces between layers are structurally weak. Such interfaces are indicated by the horizontal straight lines in FIG. 1. The layers acting as competent beds also act as loaded individual structural beams and are referred to as such at places in this description. Upon expansion, separation of various layers from adjacent layers commonly results at relatively weak interfaces between layers.

The portion of the deposit to be expanded to form an in situ oil shale retort is prepared for expansion by excavating an undercut 23 beneath the portion of the deposit to be expanded. Excavation of a portion of the deposit within the boundaries of the in situ oil shale retort site results in a void 23 having a known volume. The ceiling or roof 24 of this void forms a horizontal free face for subsequent expansion of the overlying oil shale. To the extent required the ceiling 24 above the undercut void 23 is supported by a plurality of pillars 26. One or more mining drifts such as the one indicated by reference numeral 28 lead into the undercut void and provide access between it and other underground mine workings (not shown).

The volume of the void excavated within the boundaries of the in situ retort being formed is preferably in the range of from about 10 to 25% of the total volume within the boundaries. Thus, upon subsequent explosive expansion of the portion of deposit remaining within the boundaries, the void fraction of the fragmented permeable mass of particles is in the range of from about 10 to 25%. The void fraction is preferably at least about 10% since smaller void fractions may result in undue flow resistance and excessive pumping energy. Further, when the volume of the void is low relative to the total volume of the retort being formed, a small amount of overexpansion by some of the deposit can result in an unduly small volume available for expansion of other portions, leading to parts of a fragmented mass with very low void fraction and poor permeability. It is preferred that the volume of the excavated void be less than about 25% of the total volume of the retort being formed. When the void fraction is greater than about 25% excess quantities of deposit are excavated and such excavation is expensive. Capability of the fragmented mass to support overburden can also be decreased.

The void excavated from beneath the portion of the deposit to be explosively expanded provides an underground base of operation for fracturing competent beds in the portion to be expanded. Fracturing is by way of holes drilled into the second portion and working from an underground base of operation is desirable. The total length of holes that need be drilled is reduced as compared with drilling from the surface of the ground since the portion of deposit to be fractured can lie beneath a considerable depth of overburden. Drilling from an underground base of operation also permits the drilled fracturing holes to be more precisely placed relative to the retort to be formed. The placing of fracturing devices at the proper level in the deposit is also facilitated.

After the undercut void is excavated a plurality of vertical drill holes 29 are drilled through the ceiling to substantially the entire height of that portion of the deposit to be expanded to form the in situ oil shale retort. The vertical drill holes, to the extent used only for fracturing, need not extend to the full height of the in situ retort being formed but need only extend to the competent beds to be fractured. To the extent that such drill holes are used for loading explosives for subsequent explosive expansion of the deposit, they can be drilled to the full height of the retort site.

In the embodiment illustrated in FIG. 1, the drill holes include means 30 for fracturing the oil shale deposit. The means for fracturing are located for inducing fracturing where the thick competent beds are located. Thus, means are provided for fracturing in the competent beds 15, 16, 17, 18 and 19. The means for fracturing in the various drill holes are also located at common elevations within the competent beds so as to develop generally horizontal fractures in the competent beds.

As mentioned above, the means for inducing fracturing of the competent beds in the oil shale deposit can include electrodes in the several drill holes 29. Hydraulic packers can be placed in the drill holes for use during hydraulic fracturing. Similar devices may be used for placing explosives for fracturing or enlarging fractures. Any of these techniques for fracturing can be used individually or in combination. A single group of means such as electrodes for inducing fracturing can be moved vertically through the several drill holes in the deposit from one elevation of desired fracture to another to progressively fracture the competent beds in the deposit.

It should be noted in FIG. 1 that the lowermost competent bed 19, which is a relatively thick beam, has only one elevation where means for fracturing are located and this is relatively high above the underlying thinner layers 21. Limited fracturing of the lowermost competent beam 19 maintains a ceiling over the undercut void 23 with sufficient strength not to cave in of its own accord after fracturing has been accomplished.

FIG. 2 illustrates a typical fracturing hole pattern in plan view. In this embodiment the pattern is square and has about the same dimensions as the in situ retort being formed. Thus the drill holes 29 are near the intersections of the side boundaries 13 of the in situ oil shale retort site. Means for fracturing can be activated in the drill holes 29 in pairs to effect a desired fracturing pattern. The pairing can be diagonally across the in situ retort being formed as illustrated by the diagonal dashed lines in FIG. 2. Alternatively, the pairing can be between drill holes 29 near the corners of the in situ retort being formed as indicated by the horizontal and vertical dashed lines in FIG. 2. For example, electrical linking of the four drill holes 29 illustrated in FIG. 2 provides six separate paths for inducing fractures within a single competent bed. Additional drill holes for fracturing can be used if desired.

As illustrated in FIG. 3, the thicker competent beds have been fractured, as for example by the electrical fracturing previously mentioned. The locations of fractures in the several competent beds are indicated by the wavy lines marked with reference numeral 31 and correspond to the elevations at which the means for fracturing were positioned as illustrated in FIG. 1. The fractures are indicated by wavy lines 31 in FIG. 3 only for purposes of clarity and to distinguish the fractures from the interfaces between layers illustrated by the straight horizontal lines in FIGS. 1 and 3.

After fractures have been induced in the competent beds, the drill holes 29 are loaded with explosive, typically columnar charges of explosive 32. Additional blasting holes (not shown) can also be provided within the boundaries of the in situ oil shale retort being formed to assure an adequate amount of explosive energy for fragmenting the oil shale. The support pillars 27 in the undercut void are also loaded with explosive 33.

The explosives in the portion of the deposit to be fragmented and expanded toward the void are progressively detonated in a single round beginning with explosives 33 in the support pillars 26 remaining in the undercut void and then progressively from the free face 24 above the undercut 23 to the top boundary 12 of the oil shale retort being formed. Preferably the timing of the detonation of the explosive charges is such that the ceiling over the void does not have sufficient time to collapse by itself after removal of the pillars 26. By not allowing the ceiling to collapse of its own accord but instead initiating explosive charge detonation before free ceiling collapse, good bulk permeability and void fraction distribution can be obtained throughout the fragmented permeable mass of oil shale particles in the in situ retort. In some instances, however, the ceiling can be allowed to collapse prior to detonation of the explosive charges between the ceiling of the void and the top boundary of the in situ oil shale retort.

By detonating the explosives in a single round, it is meant that the several shots in the several blasting holes are detonated either simultaneously or with short time delay detonators. Time delay detonators with intervals from 25 to 100 milliseconds up to a total delay of about 1 second are commercially available. When such time delay detonators are used there is, in effect, a single blast although various portions of the explosive detonate at different times. By blasting the oil shale with a single round of explosions for fragmenting and expanding, over-expansion of some portions and consequent under-expansion of other portions can be minimized.

One consideration in explosively expanding oil shale in the in situ oil shale retort volume for obtaining uniform bulk permeability is to expand the oil shale in all portions approximately to the extent of the excavated undercut or void. For example, if 10% of the total retort volume is represented by the portion of the oil shale removed to form the void, only a 10% expansion should occur in any portion of the deposit being expanded. If individual portions of the deposit are expanded further, there cannot be a uniform 10% void fraction, because the individual overexpanded portion will not compact enough. That is, once a fragmented mass has expanded to a relatively large void fraction, it is not recompacted later to a lower void fraction.

Figure 4:
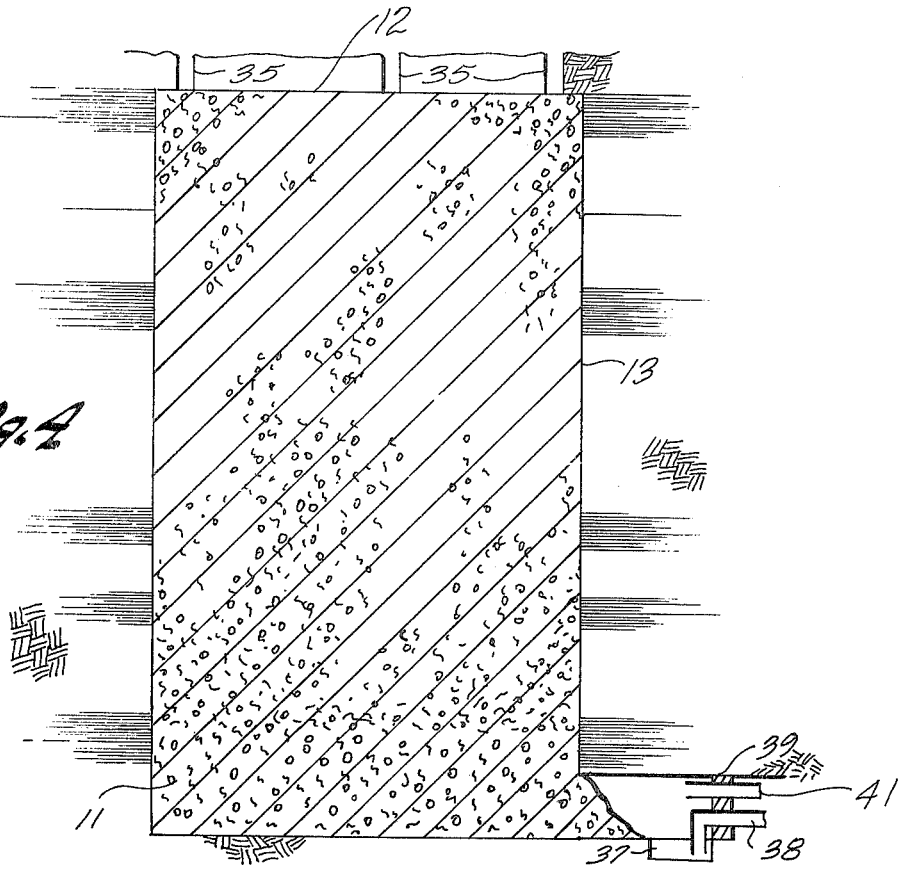
FIG. 4 is a view similar to FIG. 1 after explosive expansion of oil shale in the in situ retort.

FIG. 4 illustrates the in situ oil shale retort of FIGS. 1 to 3 after oil shale within the boundaries has been fragmented and expanded. The fragmented permeable mass of expanded oil shale in the form of a rubble pile of oil shale particles occupies much or all of the volume within the boundaries 11, 12 and 13 of the in situ oil shale retort. The volume of the void previously excavated is distributed as spaced between the oil shale particles, giving an average void fraction for the mass of fragmented oil shale particles corresponding to the proportion of the volume of the void relative to the total volume within the retort boundaries.

For purposes of retorting, conduits 35 to the top of the in situ retort provide an oxygen-supplying gas, or air diluted with other gas, for the retorting process. Carbonaceous material in the oil shale is ignited near the top of the retort to form a combustion zone. Processing gas is introduced through the conduits 35 and provides oxygen for the combustion zone which advances from the top of the fragmented permeable mass toward the bottom of the retort. Heat of combustion from the combustion zone is carried downwardly by flowing gas to a retorting zone on the advancing side of the combustion zone. In the advancing retorting zone kerogen is decomposed, producing liquid and gaseous products, including shale oil. A sump 37 in the access tunnel 28 accumulates liquid products including shale oil from the retort. Liquid products are removed by a conduit 38 extending through a bulkhead 39 from the sump 37. Another conduit 41 through the bulkhead is used for withdrawing off gas including gaseous products from the retorting process.

Figure 5:
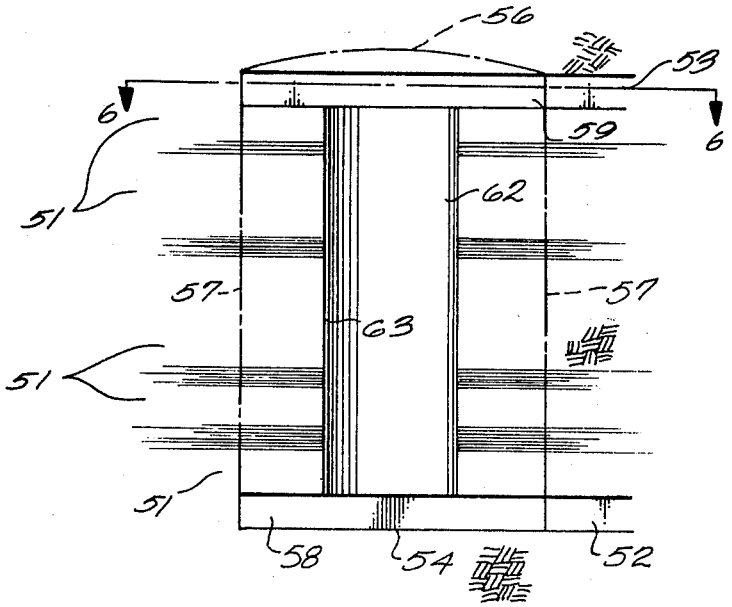
FIG. 5 is a view similar to FIG. 1 illustrating another technique for forming an in situ oil shale retort.
Figure 6:
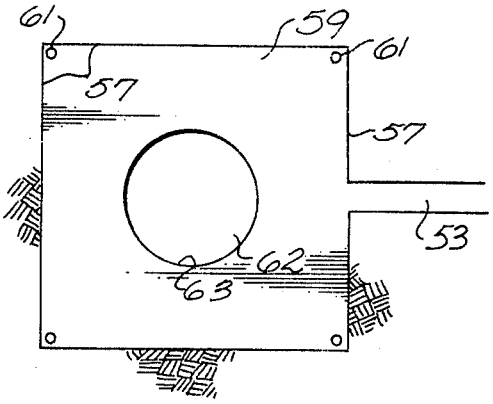
FIG. 6 is a plan view of the retort being formed in FIG. 5.

FIGS. 5 and 6 illustrate in semi-schematic vertical cross section and plan view, respectively, another technique for forming an in situ oil shale retort in practice of this invention. As illustrated in this embodiment, the oil shale deposit includes thick layers 51 of oil shale which act like competent beds or resist fragmenting during explosive expansion of the oil shale to form an in situ oil shale retort. Access drifts or tunnels 52 and 53 are excavated to the volume to become the in situ oil shale retort at a lower level and upper level, respectively. The lower access drift 52 is near the bottom boundary 54 of the in situ oil shale retort site. The upper access drift 53 is near the top boundary 56 of the in situ oil shale retort being formed. The side boundaries 57 of the retort site are illustrated in phantom in FIG. 5.

A room or void 58 is excavated at the lower level within the boundaries of the retort being formed. Similarly a room or void 59 is excavated at the upper level. In the illustrated embodiment the upper void 59 has boundaries corresponding to the side boundaries 57 of the retort being formed.

Drill holes 61 (FIG. 6) are formed in the portion of the oil shale deposit to be explosively expanded. These drill holes extend at least into those competent beds 51 it is desired to fracture. Fracturing of competent beds within the boundaries of the in situ oil shale retort being formed is carried out by electric, hydraulic or explosive means as hereinabove described. Thus, fracturing can be conducted from either of the bases of operation formed by the voids 58 or 59, as desired, just as fracturing was conducted from the undercut void 23 in the embodiment illustrated in FIGS. 1 to 4.

A columnar void 62 is excavated between the upper room 59 and the lower room 58, thereby providing a vertically extending free face 63 extending through the deposit. A technique for forming such a columnar void is described and illustrated in co-pending U.S. patent application Ser. No. 603,704, filed Aug. 11, 1975, now U.S. Pat. No. 4,043,595 and assigned to the same assignee as this application.

Blasting holes (not shown) are drilled from the overlying void 59 into the portion of the oil shale remaining within the boundaries of the retort being formed. The blasting holes are parallel to the free face 63 of the columnar void 62. A suitable pattern for such blasting holes is set forth in the aforementioned co-pending application. These blasting holes are loaded with explosive and detonated in a single round for fragmenting the portion of oil shale remaining within the retort boundaries and expanding that shale towards the void. A portion of the deposit above the ceiling of the upper void 59 is also explosively expanded toward the void for at least partly occupying the upper void. Thus, the void volume of the rooms 58 and 59 and columnar void 62 is distributed as void fraction in the spaces between the fragmented oil shale particles. Thus, for example, if the portion of oil shale excavated to form the rooms 58 and 59 and the columnar void 62 aggregates 20% of the total volume within the boundaries 54, 56 and 57 of the oil shale retort being formed, the average void fraction of the fragmented permeable mass of oil shale particles is also 20%. Fracturing of the competent beds 51 prior to fragmenting and explosive expansion of the oil shale can result in better fragmentation of thick beds and a smaller proportion of large particle sizes in the fragmented oil shale in the in situ oil shale retort.

Figure 7:
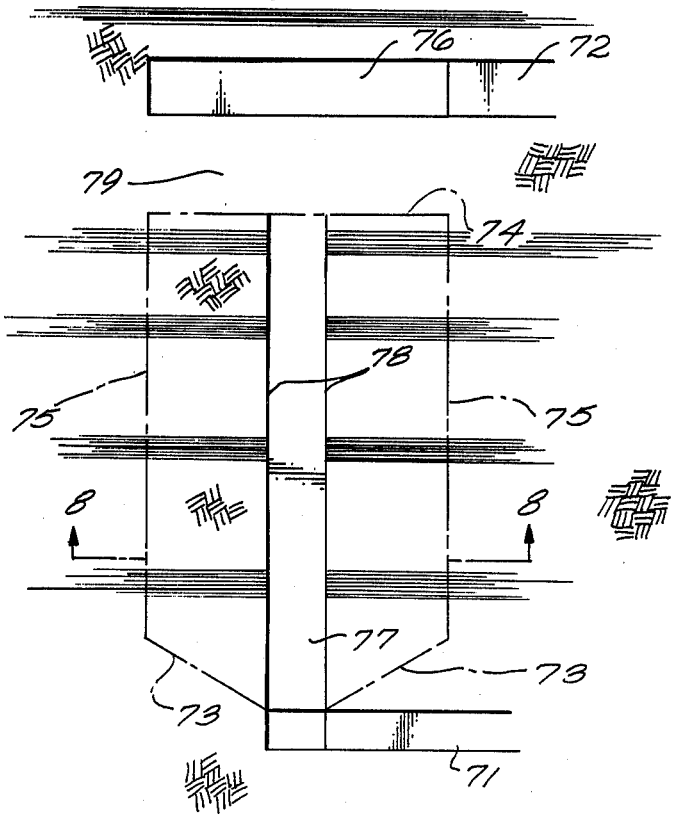
FIG. 7 is a view similar to FIG. 1 illustrating another technique for forming an in situ oil shale retort.
Figure 8:
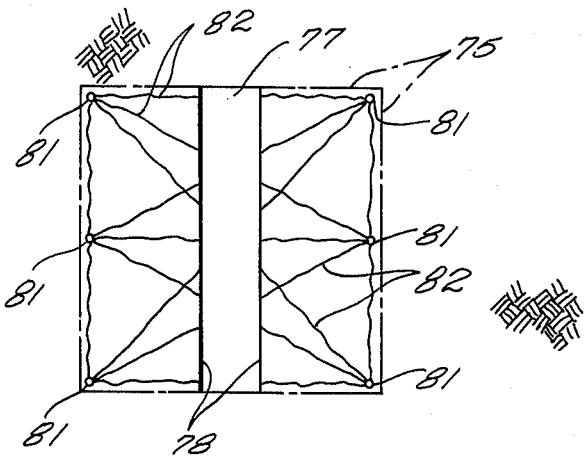
FIG. 8 is a horizontal cross section further illustrating the technique of FIG. 7.

FIGS. 7 and 8 illustrate semi-schematically in vertical and horizontal cross section, respectively, another technique for forming an in situ oil shale retort having portions of the deposit fractured in practice of this invention.

As illustrated in this embodiment, access drifts 71 and 72 are excavated at lower and upper levels, respectively, to a volume to become an in situ oil shale retort. The in situ oil shale retort site is indicated by a sloping bottom boundary 73, a top boundary 74 and side boundaries 75. A room 76 is excavated above the top boundary 74 to the extent required for access over the top of the retort site for mining and drilling operations in forming the retort. Support pillars can be left in the room 76 as desired. The overlying room 76 forms an underground base of operation suitable for fracturing portions of the deposit before explosive expansion. Additional mining includes excavation of a slot 77 extending between two of the side boundaries 75 of the retort and from the top boundary to near the bottom boundary. The lower level access drift 71 permits removal of deposit fragmented in forming the slot 77. A technique for forming a slot for formation of an in situ oil retort is described in my co-pending U.S. patent application Ser. No. 603,705, filed Aug. 11, 1975, now U.S. Pat. No. 4,043,596.

The columnar void formed by the slot 77 extending vertically through the oil shale deposit provides vertically extending free faces 78 towards which oil shale can expand. Blasting holes (not shown) are drilled vertically through the volume of oil shale to be explosively expanded toward the void. Such blasting holes are loaded with explosive and upon detonation in a single round the oil shale within the boundaries 73, 74, and 75 is fragmented and expanded towards the columnar void 77. This redistributes the void volume within the spaces between the particles of oil shale in the fragmented permeable mass formed upon explosive expansion. In this embodiment a horizontal sill pillar 79 of unfragmented deposit is left between the top boundary 74 of the fragmented permeable mass of oil shale particles in the retort and the overlying access room 76. Suitable arrangements for mining and blasting to columnar voids in the form of parallel slots are also described in the aforementioned co-pending patent application Ser. No. 603,705.

Before fragmenting the portion of deposit within the boundaries of the in situ retort being formed, it is desirable to fracture competent beds in the oil shale deposit. Preferably this fracturing occurs before the columnar void or slot 77 is excavated. Thus, for example, drill holes 81 are drilled vertically through the deposit to a sufficient extent to contact the competent beds it is desired to fracture. Such a competent bed is illustrated in the horizontal cross section of FIG. 8 taken on line 8—8 of FIG. 7. Fractures between pairs of drill holes 81 as indicated by wavy lines 82 enhance the ability of the oil shale deposit to fragment as hereinabove described. Fractures are induced in the oil shale deposit by electrical, hydraulic, and/or explosive techniques as hereinabove described in greater detail.

The following example is illustrative of a technique employed in practice of the present invention:

EXAMPLE

A 100 foot thick oil shale deposit, core drilled in Wyoming, showed 48 identifiable separate seams or layers ranging in thickness from 0.1 to 10.9 feet. Besides oil shale, these seams or layers are comprised of mudstone, sandstone and tuff. Table 1 summarizes seam data by thickness and type.

Table 1

| | Number of Seams | | | |
|---|---|---|---|---|
| Thickness | Oil Shale | Mudstone | Sandstone | Tuff & Misc |
| Less than 3 ft. | 15 | 9 | 1 | 13 |
| 3 to 6 ft. | 7 | 1 | — | — |
| Greater than 6 ft. | 2 | — | — | — |

The lowest oil shale seam was 3.8 feet thick. Immediately above that was a 0.3 foot tuff seam and above that a 9.4 foot oil shale layer.

Mining and expansion steps, preparatory to underground retorting are as follows: A square room 100 feet on a side and 20 feet high is mined out leaving the lowest 3.8 feet thick oil shale seam as the ceiling and also leaving one or more support pillars totaling approximately 30% of the 10,000 square foot room. Fracturing holes are drilled vertically 100 feet up through the ceiling in a pattern to facilitate fracturing. A pattern as shown in FIG. 2 is suitable when electrical fracturing is to be used. Additional blasting holes, not shown, are drilled to provide sufficient volume for explosive for the explosive expansion which follows the preconditioning. Six fracturing paths are shown by dashed lines in FIG. 2. Electrodes are placed in each of the fracturing holes at the same level in the deposit. For example, if the competent beds to be fractured are exactly horizontal, the electrodes will be at the same elevation in each hole. The level in each hole can be adjusted to correspond to the dip of the formation to form fractures generally parallel to the bedding planes of the deposit. The layers chosen for fracturing are those thicker than about 3 feet except that the lowermost competent bed of oil shale forming the ceiling of the room is not fractured to promote safety. If desired extra explosive can be placed in this layer upon subsequent explosive expansion to assure thorough fragmenting. In this case nine separate fractures are desired. High voltage electricity provided to a pair of electrodes at a selected level creates a fracture, as indicated by a drop in impedance. In Bureau of Mines experiments the power consumption was approximately 6 KW per linear foot. It should be noted that the fractures created are still tight, that is, while they represent real breaks in strength of the rock, air flow through them is highly restricted.

Once all the competent beds to be fractured are fractured, the electrodes are removed and both the fracturing holes and additional explosive loading holes are loaded with conventional explosives such as ANFO either as a single columnar charge in each hole or with spaces or stemming between vertical segments of explosive in each hole. Detonating devices such as detonating cord (e.g. Primacord) with time delays are used. The supporting pillar or pillars are also loaded with explosives and following detonation of these explosives, the vertical holes are detonated sequentially up the hole. The shale deposit fractures along both the pre-existing weakness planes (interfaces between layers) and the added fractures. As a result, particle size variations will be less than without the preconditioning, with the largest pieces being in general less than about 3 feet thick. Without the preconditioning, some pieces up to 10 to 11 feet thick could be expected. These would be the higher grade oil shale and a high recovery from such pieces would be difficult to achieve. The preconditioning thus improves recovery efficiency by making the higher grade oil shale more easily retortable.

The prepared retort containing a fragmented permeable mass of particles can be retorted by conventional means by providing inlets and outlets for retorting fluids, normally gaseous. One way is to drill down to the top of the fragmented mass containing oil shale and introduce gas through the drilled hole. A top portion of the fragmented mass is ignited by use of a start up fuel to establish a combustion zone. When oil shale reaches a temperature of about 800° to 900° F. it will sustain combustion. By introducing an oxygen supplying gas, the combustion zone is sustained and advanced through the fragmented mass. Heat is carried from the combustion zone to a retorting zone on the advancing side of the combustion zone. Off gas, including gaseous products of retorting oil shale in the retorting zone is withdrawn from the fragmented mass through a mine drift at the bottom. Liquid products including retorted shale oil are withdrawn from the bottom of the fragmented mass. Preferably only the amount of gas necessary for proper heat balance is used. A suitable gas volume during retorting is in the range of from about 1 to 4 SCF/min./ft$^2$ of retort cross-sectional area.

What is claimed is:

1. A method of producing liquid and gaseous products including shale oil from an in situ oil shale retort containing a fragmented permeable mass of particles containing oil shale and having boundaries of subterranean deposit containing deposition layers of oil shale, wherein at least a portion of the deposition layers are bonded together as at least one competent bed, which comprises the steps of:

excavating a first portion of the deposit from within the boundaries of the in situ oil shale retort being formed to form at least one void within said boundaries, the surface of the deposit defining such a void providing at least one free face extending through the deposit within said boundaries and leaving a second portion of the deposit within said boundaries extending away from such a free face, said second portion including at least one competent bed;

fracturing such a competent bed in the second portion substantially parallel to the deposition layers for reducing the effective thickness of such competent bed;

explosively expanding the second portion, including such a fractured bed, toward such a free face for forming a fragmented permeable mass of particles containing oil shale in an in situ oil shale retort being formed; and retorting the fragmented permeable mass containing oil shale in the in situ shale retort for producing liquid and gaseous products including shale oil.

2. A method of producing liquid and gaseous products including shale oil from an in situ oil shale retort containing a fragmented permeable mass of particles containing oil shale and having boundaries of subterranean deposit containing deposition layers of oil shale, wherein at least a portion of the deposition layers are bonded together as at least one competent bed, which comprises the steps of:

excavating a first portion of the deposit from within the boundaries of the in situ oil shale retort being formed to form at least one void within said boundaries, the surface of the deposit defining such a void providing at least one free face extending through the deposit within said boundaries and leaving a second portion of the deposit within said boundaries extending away from such a free face, said second portion including at least one competent bed, wherein the first portion of the deposit is excavated adjacent the lower boundary of the in situ oil shale retort leaving the second portion including at least one competent bed above the excavated void for providing a horizontally extending free face defined by the overlying second portion;

fracturing such a competent bed in the second portion substantially parallel to the deposition layers for reducing the effective thickness of such competent bed;

explosively expanding the second portion, including such a fractured bed, toward such a free face for forming a fragmented permeable mass of particles containing oil shale in an in situ oil shale retort being formed; and retorting the fragmented permeable mass containing oil shale in the in situ oil shale retort for producing liquid and gaseous products including shale oil.

3. A method of producing liquid and gaseous products as recited in claim 2 wherein the second portion of the deposit above the horizontally extending free face is explosively expanded by:

drilling a plurality of blasting holes vertically from the free face into said second portion of the deposit;

loading explosive into the blasting holes; and detonating the explosive.

4. A method of producing liquid and gaseous products including shale oil from an in situ oil shale retort containing a fragmented permeable mass of particles containing oil shale and having boundaries of subterranean deposit containing deposition layers of oil shale, wherein at least a portion of the deposition layers are bonded together as at least one competent bed, which comprises the steps of:

excavating a first portion of the deposit from within the boundaries of the in situ shale retort being formed to form at least one void within said boundaries, the surface of the deposit defining such a void providing at least one free face extending through the deposit within said boundaries and leaving a second portion of the deposit within said boundaries extending away from such a free face, said second portion including at least one competent bed;

fracturing such a competent bed in the second portion substantially parallel to the deposition layers for reducing the effective thickness of such competent bed;

explosively expanding the second portion, including such a fractured bed, toward such a free face for forming a fragmented permeable mass of particles containing oil shale in an in situ oil shale retort being formed; and retorting the fragmented permeable mass containing oil shale in the in situ oil shale retort for producing liquid and gaseous products including shale oil and wherein at least one such competent bed is fractured by drilling a plurality of holes into the competent bed and fracturing the competent bed from a plurality of such holes at the same level in the competent bed.

5. A method of producing liquid and gaseous product including shale oil from an in situ oil shale retort containing a fragmented permeable mass of particles containing oil shale and having boundaries of subterranean deposit containing deposition layers of oil shale, wherein at least a portion of the deposition layers are bonded together as at least one competent bed, which comprises the steps of:

excavating a first portion of the deposit from within the boundaries of the in situ oil shale retort being formed to form at least one void within said boundaries, the surface of the deposit defining such a void providing at least one free face extending vertically through the deposit within the boundaries and leaving a second portion of the deposit within said boundaries extending away from such a free face, said second portion including at least one competent bed;

fracturing such a competent bed in the second portion substantially parallel to the deposition layers for reducing the effective thickness of such competent bed;

drilling a plurality of blasting holes in said second portion of the deposit parallel to the free face;

loading explosive into the blasting holes;

detonating the explosive in a single round for explosively expanding the second portion, including such a fractured bed, toward such a free face for forming a fragmented permeable mass of particles containing oil shale in an in situ oil shale retort being formed; and retorting the fragmented permeable mass containing oil shale in the in situ oil shale retort for producing liquid and gaseous products including shale oil.

6. A method of producing liquid and gaseous products including shale oil from an in situ oil shale retort containing a fragmented permeable mass of particles containing oil shale and having boundaries of subterranean deposit containing deposition layers of oil shale, wherein at least a portion of the deposition layers are bonded together as at least one competent bed, which comprises the steps of:

excavating a first portion of the deposit from within the boundaries of the in situ oil shale retort being formed to form at least one void within said boundaries, the surface of the deposit defining such a void providing at least one free face extending through the deposit within said boundaries and leaving a second portion of the deposit within said boundaries extending away from such a free face, said second portion including at least one competent bed;

fracturing such a competent bed in the second portion substantially parallel to the deposition layers for reducing the effective thickness of such competent bed;

explosively expanding the second portion, including such a fractured bed, toward such a free face for forming a fragmented permeable mass of particles containing oil shale in an in situ oil shale retort being formed; and retorting the fragmented permeable mass containing oil shale in the in situ oil shale retort for producing liquid and gaseous products including shale oil; and wherein the volume of the excavated first portion within the boundaries of the in situ retort being formed is in the range of from about 10 to 25% of the total volume within the boundaries of the in situ retort being formed.

7. A method of forming an in situ oil shale retort in a subterranean deposit containing deposition layers of oil shale, said in situ retort containing a fragmented permeable mass of particles containing oil shale and having boundaries of said deposit, wherein at least a portion of the deposition layers are bonded together as at least one competent bed, which comprises the steps of:

excavating a first portion of the deposit from within the boundaries of the in situ oil shale retort being formed to form at least one void within said boundaries, the surface of the deposit defining such a void providing at least one free face extending through the deposit within said boundaries and leaving a second portion of the deposit within said boundaries extending away from such a free face, said second portion including at least one competent bed;

fracturing such a competent bed in the second portion substantially parallel to the deposition layers for reducing the effective thickness of such competent bed; and explosively expanding the second portion, including such a fractured bed, toward such a free face for forming a fragmented permeable mass of particles containing oil shale in an in situ oil shale retort being formed.

8. A method of forming an in situ oil shale retort in a subterranean deposit containing deposition layers of oil shale, said in situ retort containing a fragmented permeable mass of particles containing oil shale and having boundaries of said deposit, wherein at least a portion of the deposition layers are bonded together as at least one competent bed, which comprises the steps of:

excavating a first portion of the deposit adjacent the lower boundary and from within the boundaries of the in situ oil shale retort being formed to form at least one void within said boundaries, the surface of the deposit defining such a void providing at least one horizontally extending free face extending through the deposit within said boundaries and leaving a second portion of the deposit within said boundaries extending away from such a free face, said second portion including at least one competent bed, above the excavated void;

fracturing such a competent bed in the second portion substantially parallel to the deposition layers for reducing the effective thickness of such competent bed; and explosively expanding the second portion, including such a fractured bed, toward such a free face for forming a fragmented permeable mass of particles containing oil shale in an in situ oil shale retort being formed.

9. A method of forming an in situ oil shale retort as recited in claim 8 wherein such a competent bed in the second portion of the deposit is fractured by drilling a plurality of fracturing holes into such a competent bed in the second portion from the void formed by excavating said first portion, and fracturing such competent bed from said void.

10. A method of forming an in situ oil shale retort as recited in claim 8 wherein the second portion of the deposit above the horizontally extending free face is explosively expanded by;

drilling a plurality of blasting holes vertically from the free face into said second portion of the deposit;

loading explosive into the blasting holes; and detonating the explosive.

11. A method of forming an in situ oil shale retort in a subterranean deposit containing deposition layers of oil shale, said in situ retort containing a fragmented permeable mass of particles containing oil shale and having boundaries of said deposit, wherein at least a portion of the deposition layers are bonded together as at least one competent bed, which comprises the steps of:

excavating a first portion of the deposit from within the boundaries of the in situ oil shale retort being formed to form at least one void within said boundaries, the surface of the deposit defining such a void providing at least one free face extending through the deposit within said boundaries and leaving a second portion of the deposit within said boundaries extending away from such a free face, said second portion including at least one competent bed;

fracturing such a competent bed in the second portion substantially parallel to the deposition layers for reducing the effective thickness of such competent bed; and explosively expanding the second portion, including such a fractured bed, toward such a free face for forming a fragmented permeable mass of particles containing oil shale in an in situ oil shale retort being formed; and wherein at least one competent bed is fractured by drilling a plurality of holes into the competent bed and fracturing the competent bed from a plurality of such holes at the same level in the competent bed.

12. A method of forming an in situ oil shale retort in a subterranean deposit containing deposition layers of oil shale, said in situ retort containing a fragmented permeable mass of particles containing oil shale and having boundaries of said deposit, wherein at least a portion of the deposition layers are bonded together as at least one competent bed, which comprises the steps of:

excavating a first portion of the deposit from within the boundaries of the in situ oil shale retort being formed to form at least one void within said boundaries, the surface of the deposit defining such a void providing at least one free face extending vertically through the deposit within the boundaries and leaving a second portion of the deposit within said boundaries extending away from such a free face, said second portion including at least one competent bed;

fracturing such a competent bed in the second portion substantially parallel to the deposition layers for reducing the effective thickness of such competent bed;

drilling a plurality of blasting holes in said second portion of the deposit parallel to the free face;

loading explosive into the blasting holes; and detonating the explosive in a single round for explosively expanding the second portion, including such a fractured bed, toward such a free face for forming a fragmented permeable mass of particles containing oil shale in an in situ oil shale retort being formed.

13. A method of forming an in situ oil shale retort in a subterranean deposit containing deposition layers of oil shale, said in situ retort containing a fragmented permeable mass of particles containing oil shale and having boundaries of said deposit, wherein at least a portion of the deposition layers are bonded together as at least one competent bed, which comprises the steps of:

excavating a first portion of the deposit from within the boundaries of the in situ oil shale retort being formed to form at least one void within said boundaries, the surface of the deposit defining such a void providing at least one free face extending through the deposit within said boundaries and leaving a second portion of the deposit within said boundaries extending away from such a free face, said second portion including at least one competent bed;

fracturing from an underground base of operation such a competent bed in the second portion substantially parallel to the deposition layers for reducing the effective thickness of such competent bed; and explosively expanding the second portion, including such a fractured bed, toward such a free face for forming a fragmented permeable mass of particles containing oil shale in an in situ oil shale retort being formed.

14. A method of forming an in situ oil shale retort as recited in claim 13 wherein the base of operation is above the second portion to be explosively expanded and fracturing holes are drilled downwardly into said second portion.

15. A method of forming an in situ oil shale retort as recited in claim 13 wherein the base of operation is below the second portion to be explosively expanded and fracturing holes are drilled upwardly into said second portion.

16. A method of forming an in situ oil shale retort in a subterranean deposit containing deposition layers of oil shale, said in situ oil shale retort containing a fragmented permeable mass of particles containing oil shale and having boundaries of said deposit, wherein at least a portion of the deposition layers are bonded together as at least one competent bed, which comprises the steps of:

excavating a first portion of the deposit from within the boundaries of the in situ oil shale retort being formed to form at least one void beneath a second portion of the deposit left within the boundaries, the surface of the second portion adjacent such a void defining a horizontally extending free face, said second portion including at least one competent bed;

fracturing a part of the second portion that acts as a competent bed and which is to be expanded in the in situ oil shale retort while leaving at least one competent bed unfractured adjacent such a horizontally extending free face; and explosively expanding the second portion including such a fractured bed toward such a void for forming a fragmented permeable mass of particles containing oil shale in the in situ oil shale retort.

17. A method of forming an in situ oil shale retort as recited in claim 16 wherein such a competent bed in the second portion of the deposit is fractured by drilling a plurality of fracturing holes into such a competent bed in the second portion from the void formed by excavating said first portion, and fracturing such competent bed from said void.

18. A method of forming an in situ oil shale retort as recited in claim 17 wherein at least one competent bed is fractured from a plurality of such fracturing holes at the same level in the competent bed.

19. A method of forming an in situ oil shale retort in a subterranean deposit containing deposition layers of oil shale, said in situ retort containing a fragmented permeable mass of particles containing oil shale and having boundaries of said deposit, wherein at least a portion of the deposition layers are bonded together as at least one competent bed, which comprises the steps of:

fracturing at least one portion of the deposit that acts as a competent bed;

excavating a first portion of the deposit from within the boundaries of the in situ oil shale retort being formed to form at least one void within said boundaries, the surface of the deposit defining such a void providing at least one free face extending vertically through the deposit within said boundaries, and leaving a second portion of the deposit within said boundaries extending away from such a free face, said second portion including at least one fractured portion; and explosively expanding the second portion, including such a fractured portion, toward such a free face for forming a fragmented permeable mass of particles containing oil shale in an in situ oil shale retort.

20. A method of forming an in situ oil shale retort as recited in claim 19 further comprising the step of excavating an underground base of operation above the second portion to be explosively expanded, and wherein the fracturing step is conducted from said underground base of operation.

21. A method of forming an in situ oil shale retort wherein oil shale adjacent to a void excavated in an oil shale deposit is explosively expanded toward a free face on deposit adjacent the void to form the in situ oil shale retort, and further wherein certain deposition layers of oil shale in the deposit within which the in situ oil shale retort is to be formed are bonded together as competent beds which comprise the steps of:

fracturing through at least a portion of the competent beds in the portion to become the in situ oil shale retort to reduce the strength of the competent beds and separate the competent beds into thinner beds, and thereafter, explosively expanding the oil shale including a fractured portion of a competent bed toward such a free face to form the in situ oil shale retort.

22. A method of producing liquid and gaseous products as recited in claim 2 in which a lowermost competent bed above the horizontally extending free face is left sufficiently competent to maintain a ceiling above the excavated void with sufficient strength not to cave in of its own accord after fracturing.

23. A method of producing liquid and gaseous products as recited in claim 8 in which a lowermost competent bed above the horizontally extending free face is left sufficiently competent to maintain a ceiling above the excavated void with sufficient strength not to cave in of its own accord after fracturing.

24. A method of forming an in situ oil shale retort as recited in claim 7 wherein the total void volume of the fragmented mass is substantially the same as the volume of the evcavated void.

* * * * *

UNITED STATES PATENT AND TRADEMARK OFFICE

CERTIFICATE OF CORRECTION

PATENT NO. : 4,109,964

DATED : August 29, 1978

INVENTOR(S) : Richard D. Ridley

It is certified that error appears in the above-identified patent and that said Letters Patent are hereby corrected as shown below:

Column 1, line 21, "upo" should be -- upon --;
Column 1, line 36, "rotort" should be -- retort --;
Column 1, line 60, "by" should be -- be --.
Column 3, line 63, "drilld" should be -- drilled --.
Column 5, line 34, "the" should be -- The --.
Column 6, line 58, "betwen" should be -- between --.
Column 14, line 11, --oil -- should be inserted after "situ" and before "shale".
Column 15, line 23, "product" should be -- products --.
Column 17, line 20, the semi-colon should be a colon.
Column 20, line 24, after "beds" the comma should be a semi-colon.

Signed and Sealed this

*Seventeenth* Day of *April 1979*

[SEAL]

*Attest:*

RUTH C. MASON
*Attesting Officer*

DONALD W. BANNER
*Commissioner of Patents and Trademarks*